United States Patent [19]

Gareis

[11] 4,039,816

[45] Aug. 2, 1977

[54] ARRANGEMENT FOR TRANSMITTING LIGHT ENERGY

[76] Inventor: Richard Gareis, 9 Ziegetsdorfer Str., Regensburg, Germany, 8400

[21] Appl. No.: 619,872

[22] Filed: Oct. 6, 1975

[30] Foreign Application Priority Data

| | | |
|---|---|---|
| Oct. 8, 1974 | Germany | 2447832 |
| Nov. 14, 1974 | Germany | 37945[U] |

[51] Int. Cl.[2] ..... F21P 5/02; F21V 7/12

[52] U.S. Cl. ..... 240/1 EL; 240/10 R; 240/106 R

[58] Field of Search ..... 240/1 EL, 1 LP, 106 R, 240/106.1, 10 R, 10 LP, 41.3

[56] References Cited

U.S. PATENT DOCUMENTS

| | | | |
|---|---|---|---|
| 2,480,178 | 8/1949 | Zinberg | 240/10 L |
| 3,043,947 | 7/1962 | Albinger | 240/1 EL |

*Primary Examiner*—L. T. Hix
*Assistant Examiner*—J. A. LaBarre
*Attorney, Agent, or Firm*—Michael P. Breston

[57] ABSTRACT

The arrangement transmits light energy from a light source by means of a stack of light-conducting members having surfaces which are approximately parallel to a common plane. The members are arranged around the light source and their outward ends define reflecting surfaces. Each member collects a portion of the light energy emanating from the light source and guides its portion of the collected light energy along a prescribed path to its reflecting surface.

15 Claims, 4 Drawing Figures

ARRANGEMENT FOR TRANSMITTING LIGHT ENERGY

BACKGROUND OF THE INVENTION

In the field of optics or illumination, there is a need for transmitting light energy in a prescribed manner. The available light sources, for example, gas discharge lamps, incandescent lamps, etc., are not generally point sources since their light producing means such as gas discharge paths, tungsten filament coils, etc., are by virtue of their shape extended in space to a certain extent. Therefore, it is extremely difficult, in the case of conventional devices, to make fullest use of the total energy of a light source for the required purpose, or to transmit the light in an optically correct or concentrated manner to a light utilization device.

In order to keep optical errors as low as possible, conventional projection methods use special light sources whose light-radiating means are as point-shaped as possible. These light sources, however, are relatively expensive, have a very short operating life, and, moreover, their maximum output power is limited. With more sophisticated designs of the coiled filaments or of the gas discharge paths, a longer life and higher power are obtainable; however, optically accurate geometry is difficult to achieve therewith.

Conventional light-generating units are neither characterized by optimum light yield nor by optimum light transmission. In particular, conventional home light fixtures which utilize high power light sources produce undesirable glare. For this reason conventional light fixtures, or lamp assemblies, especially those utilized in homes, are restricted to the use of light sources, typically incandescent lamps, with relatively low luminance, in which case, to produce a large luminous flux, a plurality of smaller light sources are required.

Light sources with very high luminance, for example with luminances up to a 100 times the luminance of a standard incandescent lamp, are well known; however, they cannot be considered for use in home light fixtures or for lamp assemblies because of their high glare effect, the reason being that with conventional means it is difficult to radiate out the light of high-power light sources in a diffused and glare-free manner, even though high-power light sources are considerably more efficient than low-power light sources.

It is a broad object of this invention to provide an arrangement which radiates out light by relatively simple means, more specifically, the arrangement makes it possible to collect the output light of light sources, which are not even point-shaped, into beams of light in an optically correct manner, or to concentrate or to radiate out the light in a glare-free and diffused manner.

SUMMARY OF THE INVENTION

The arrangement for oriented transmission of light in accordance with this invention comprises a stack of light-conducting members which are approximately parallel to a common plane and are arranged around the light source. The light-conducting members may have any thickness and their ends which are remote from the light source are provided with light-reflecting surfaces that are arranged in such a manner that portions of the light energy, radiated out by a gas discharge path, by a coiled tungsten filament, or by similar lightemitting means, are absorbed by the light-conducting members.

Each member conducts the absorbed light energy in an oriented manner to its reflecting surface.

In a preferred embodiment of the invention, the light-conducting members are light-conducting disc reflectors, i.e., discs which are arranged concentrically around the light source, and preferably, concentrically to the long thin coiled filament, or to the long thin gas discharge path of the light source. The discs have on their outside edges inclined planes which form the desired reflecting surfaces for the light directed radially into the discs. The thicknesses of the discs are matched for the intended purpose. It may be useful, however, to keep the thickness of these light-conducting discs as small as possible, in order to obtain the best possible light-directing effect for the discs, that is, to ensure that the light which is radially guided into the discs will be transmitted as parallel as possible to a common plane and to the discs' surfaces.

DESCRIPTION OF THE PREFERRED EMBODIMENTS

Figure 1:
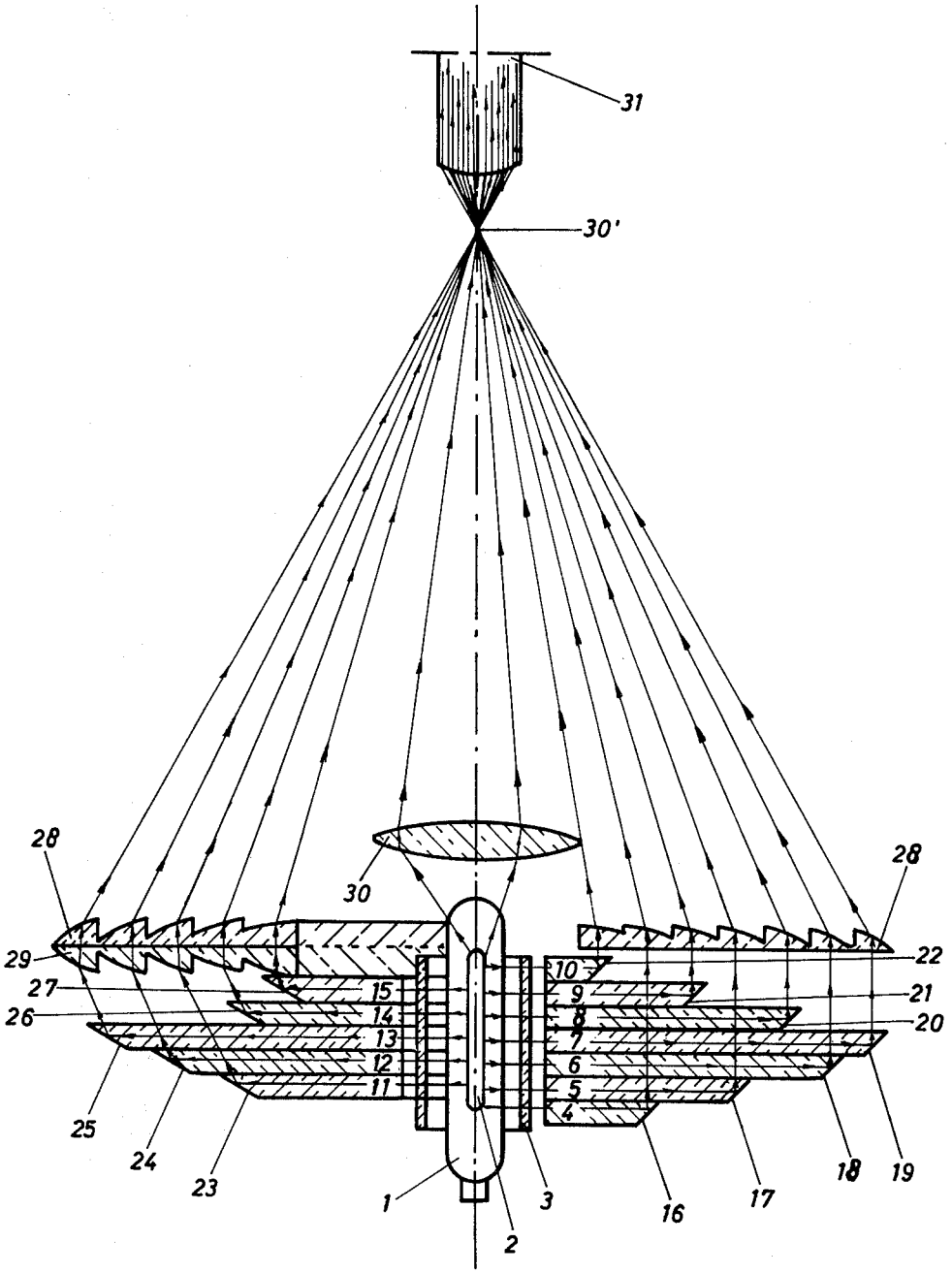
FIG. 1 is a schematic representation of one embodiment of the invention for concentrating light energy onto a common focal point.

In FIG. 1 the light energy radiated from the light source 1 or from the long thin gas discharge path 2 is continuously conducted through a heat-absorbing glass cylinder 3 into a stack of disc-shaped, light-conducting reflectors 4–10 or 11–15, which can have any desired diameter and thickness; the dimensions are selected for the intended purpose.

The light is deflected by the reflecting surfaces 16–22 or 23–27 and light is subsequently conducted to the circular component lenses of a Fresnel lens 28, which is arranged vertically above the reflecting surfaces, either directly or by means of an interposed circular lens disc 29, which is arranged directly under 28 and is matched to the Fresnel lens 28. The circular lens disc 29 has constant circular lens radii of curvature. The term circular lens disc is understood to mean an arrangement similar to a Fresnel lens, in which the circular lens surfaces or the ring surfaces of this circular lens disc have a constant radius of curvature, while the radii of curvatures of individual circular lens surfaces, or of the ring surfaces, are different in a Fresnel lens, and these radii decrease from the center of the lens towards the edge of the lens.

From the circular lens surfaces of the Fresnel lens 28 the light energy is subsequently directed to a common focal point 30' from which it is transmitted into a light-conducting rod 31. The possibility of reducing the number of disc type reflectors as well as their diameters in relation to the Fresnel lens can be used, as shown by 23, 24, 25, 26 and 27.

The light which is transmitted from the light source upwards at an angle, as well as vertically upwards, is additionally collected by a collector lens 30 arranged above the light source and this light is also transmitted in an oriented manner into the light-conducting rod 31. The superposition of light-conducting disc reflectors in the described manner has the following advantages:

1. Oriented light energy supplied to the reflecting surfaces of the light-conducting disc reflectors is accurate for all practical purposes.

2. The accurately-oriented light energy supply makes it possible to also produce an accurate vertical transmission of light by the reflecting surfaces of the light-conducting disc reflectors, preferably by total internal reflection to the lens surfaces of the Fresnel lens, so that a much more accurate focal point is achieved by this means as compared to what was achievable with short or very-short focal lengths, or with conventional parabolic reflectors or with parabolic mirrors and Fresnel lenses.

3. Enormously high light energy is yielded from the light source, because the light-conducting disc reflectors are arranged in the immediate vicinity of the light source in an ideal manner.

4. Losses of light are lower, using the near total reflection capabilities of the light-conducting disc reflectors, compared with the oriented or scattered reflection of metallic or mirror-coated parabolic reflectors.

Figure 2:
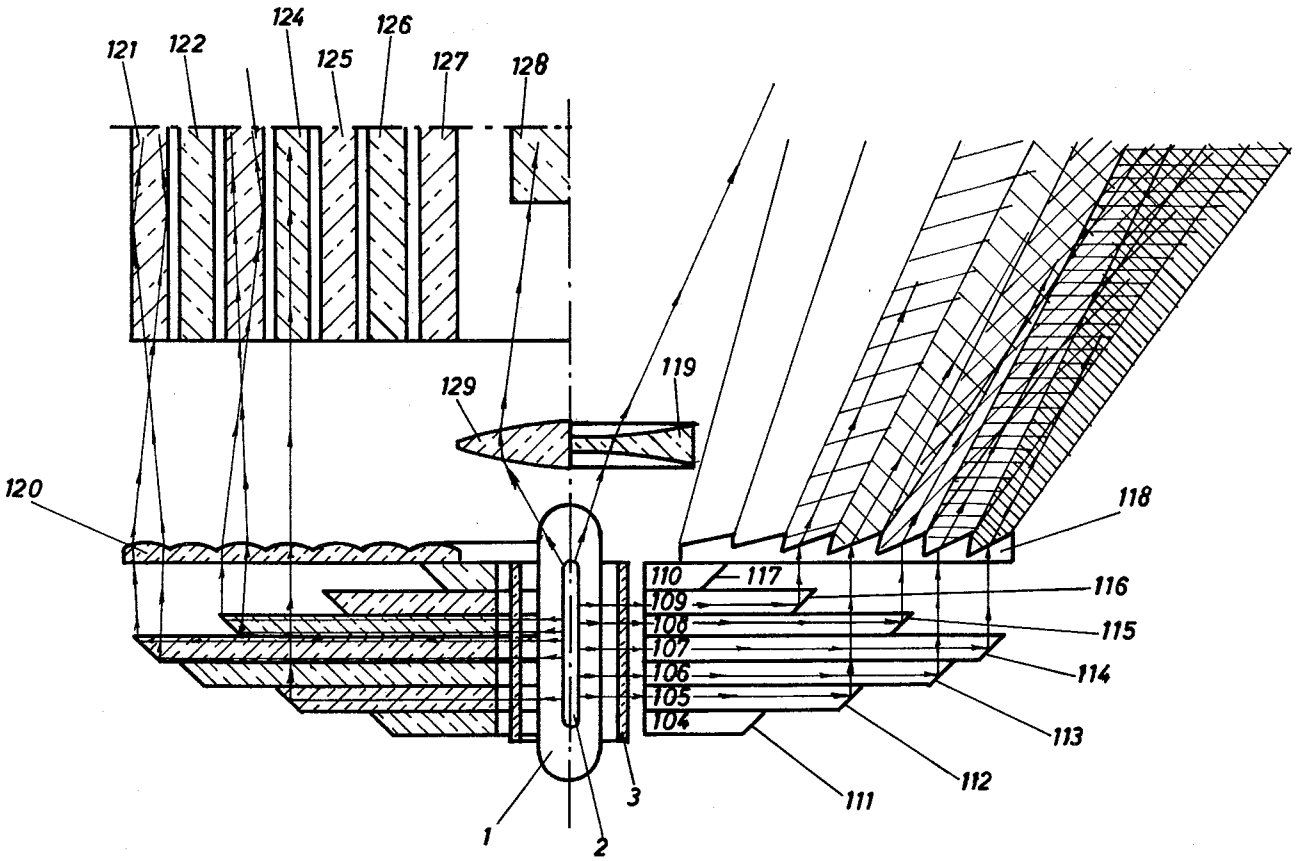
FIG. 2 shows an arrangement similar to FIG. 1, but for surface distribution of the light energy.

FIG. 2 shows an arrangement similar to that shown in FIG. 1, with the difference that in the version according to FIG. 2, a light concentration on a common focal point does not take place, but a more extended surface distribution of light energy will be achieved. The light energy radiated out from the light source 1, or from the thin gas discharge path 2, is also continuously supplied, through the heat-absorbing glass cylinder 3 to a stack of light-conducting disc reflectors 104–110. The light reaches their reflecting surfaces 111–117, respectively, and light is transmitted vertically, preferably by total internal reflection, either to a disc 118 which is provided with inclined, circular ring surfaces, or on the other hand, to a disc 119 which is provided with concave, circular ring surfaces.

The light energy supplied in the first case to the disc 118 is refracted outwards by the inclined sloping circular ring surfaces into a divergent light cone. The angle is determined by the angle of the individual inclined circular ring surfaces, i.e., by the angle between these circular ring surfaces and the radius of the disc 118.

Since in the case of high-pressure discharge lamps and also in the case of halogen incandescent lamps, the light density is always maximum in the middle of the gas discharge space or in the middle of the long, thin tungsten coil, a corresponding arrangement of the light-conducting disc reflectors 104–110 makes it possible to produce a corresponding luminous intensity distribution in the light cone transmitted by the disc 118. The luminous intensity distribution can be adjusted in such a manner that it can increase or decrease from outside to inside in the transmitted light cone. Hence, for example, a maximum light concentrations or luminous intensity can be achieved with a certain angle of the inclined lateral surfaces of the disc 118, so that the generated light cone has a luminous intensity which increases from the inside to the outside. This is of great importance for the incident light or transmitted light application methods in large format photography (with wide angle cameras) because it is possible, with a light cone whose luminosity varies, to achieve an illumination of the object to be photographed. With such illumination a uniform exposure of the photographic film is assured.

It is even simpler to modify the luminous intensity distribution in the transmitted light cone by means of the arrangement shown in FIG. 2, so that the luminous intensity increases from inside towards the outside. Light energy transmitted from the light source 1 upwards at an angle and vertically upwards, is, for example, collected by a biconcave lens 129 and directed, depending on the intended purpose, through this lens.

The light energy supplied to a disc 120 by the light conducting disc reflectors 104–110 is directed by the lens shaped circular ring surfaces in the disc 120 accurately and sharply into the cylindrical light conductors 121–127 which are preferably arranged concentrically. In this case too, as already explained above, it is again possible and useful to supply the high luminous intensity to the outside cylindrical light conductors. The light energy radiated by the light source 1 upwards at an angle, as well as vertically upwards, is supplied by the biconvex lens 129, in addition to a rod-shaped, light conductor 128.

Figure 3:
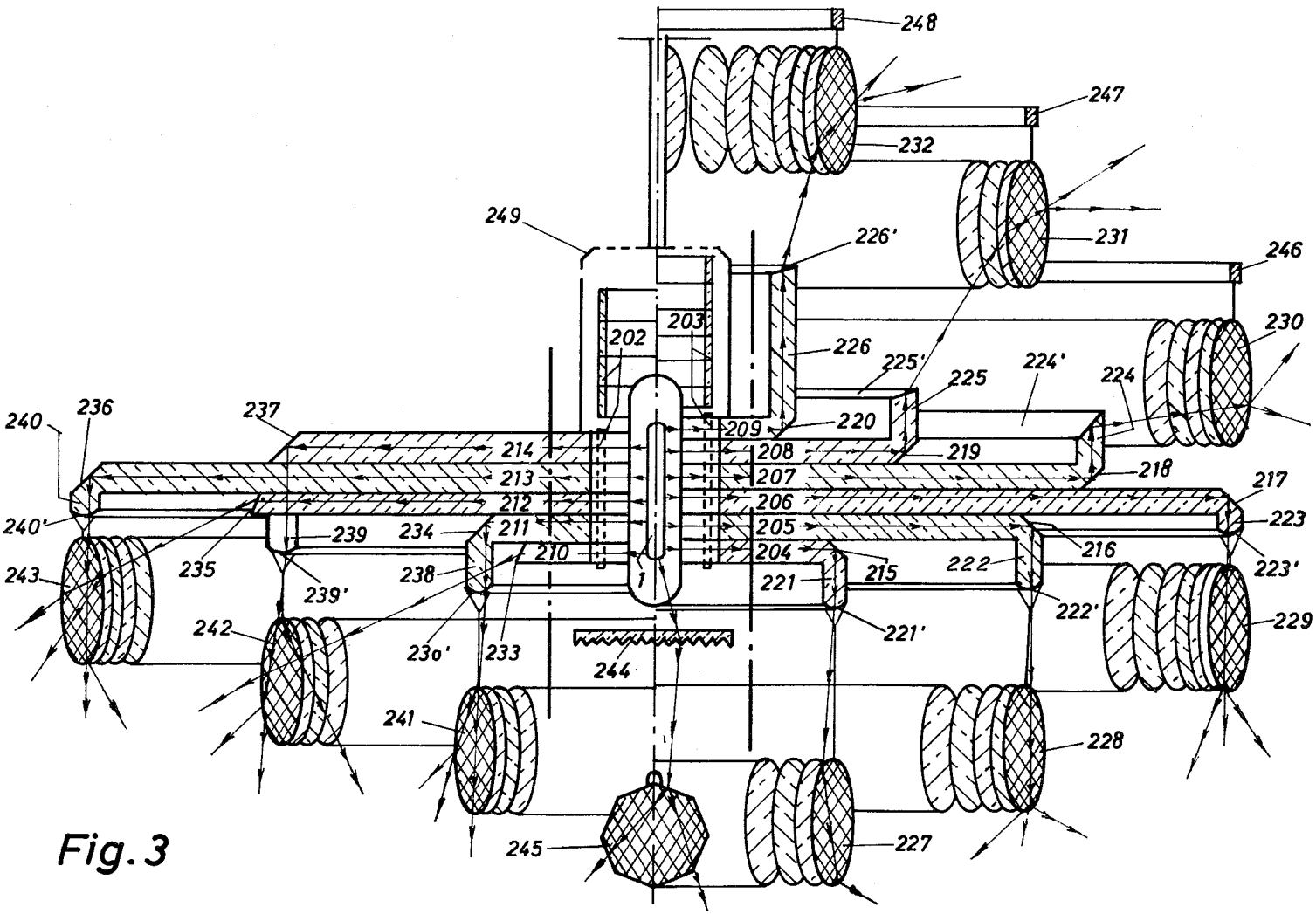
FIG. 3 shows a diagrammatic sectional arrangement according to the invention in the form of a light fixture.
Figure 4:
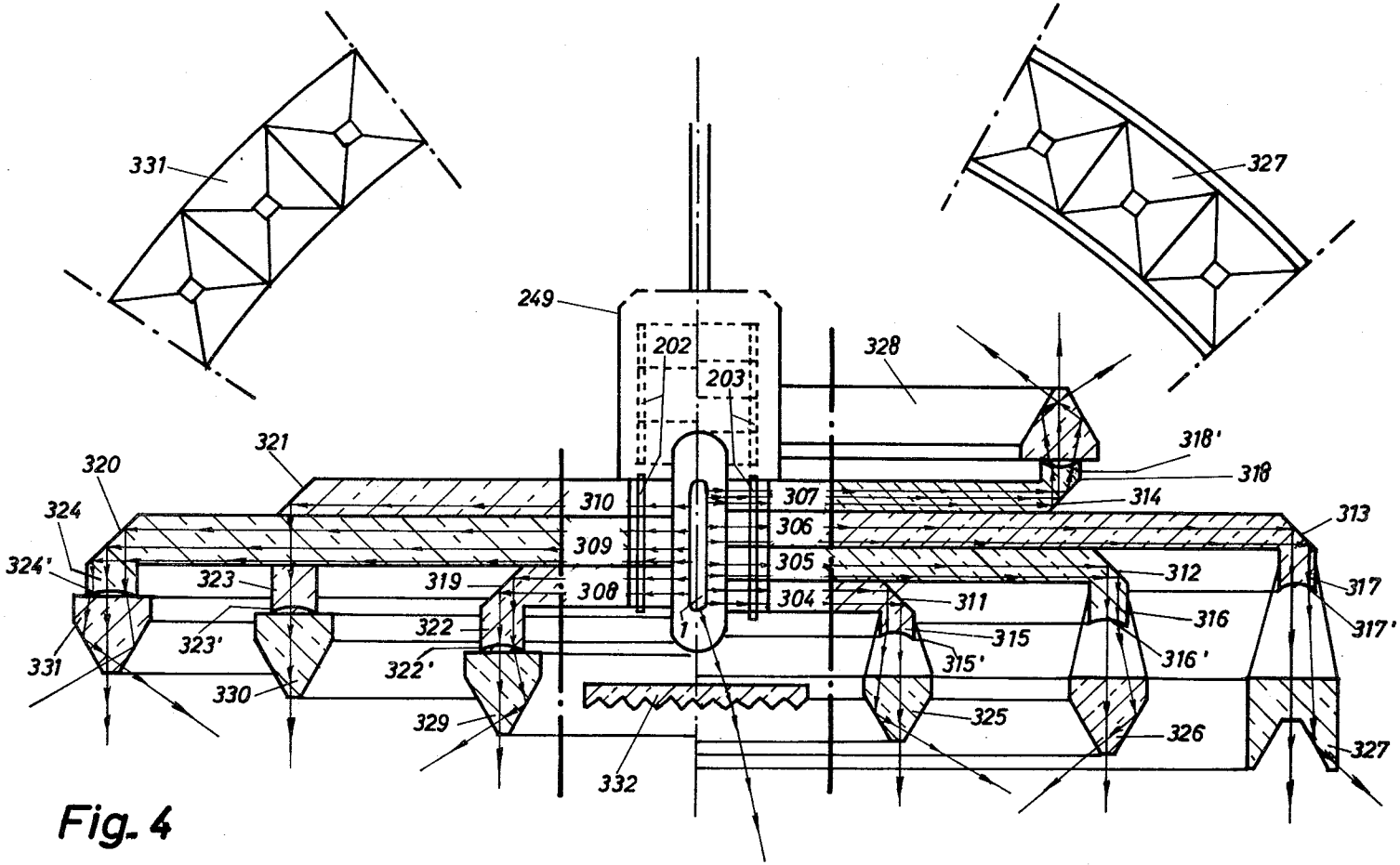
FIG. 4 is a diagrammatic sectional representation of another embodiment of the arrangement according to the invention in the form of a light fixture.

FIGS. 3 and 4 show an example of application of the arrangement according to the invention as a light fixture. In FIG. 3 the light energy radiated from the light source 1, or by the long, thin gas discharge path 2 of the light source, is continuously transmitted either directly or through interposed cylindrical colored filter glasses 202, 203 into superposed and disc or plate-shaped light-conducting bodies 204–209 or 210–214.

The light supplied by the light-conducting bodies is conducted further by the reflecting surfaces 215 to 220 and 234, 236 and 237 through projections 221 to 226 and 238 to 240, which are positioned at right angles to these disc-shaped, light-conducting bodies, to the convex circular ring surfaces 221' to 223' and 238' to 240', or the inclined circular ring surfaces 224' to 226' provided on said projections. The light is directed by the projections to the light-refracting or light-scattering bodies 227–232 or 241–243, which are fastened in a suitable manner above the projections 224–226 or below the projections 221–223 and 238–240. These light-scattering bodies, which can have any geometrical shape, distribute the light supplied by the light source 1 by multiple refraction and in a scattered manner into the surrounding space such as a room. An additional light-directing effect to the light-refracting or light-scattering bodies (in the version shown, for example, the bodies 242 and 243) can be achieved by the inclined surfaces 233 and 235.

The number and the diameters of the disc-shaped light-conducting bodies 204–209 or 210–214 are matched to the long, thin gas discharge space 2 (or to a long, thin coiled filament) of the light source 1 in such a manner that in the case of a corresponding match of all angles of the reflecting surfaces of each angular section (for example of a spherical surface) are covered by a circular light cone directed onto it. The light emerging from the light source 1 downwards at an angle and vertically downwards is transmitted additionally by the light-refracting or light-scattering bodies 244 and 245 without glare into the room. The body 244 in this case, for example, consists of a disc on whose underside are pressed circular grooves.

In addition to the neutral light radiated by the light source 1 to the light fixture, it is possible to operate the light fixtures without special effort, with a number of colors by means of the cylindrical colored filter glasses 202 and 203 which are accommodated in the housing 249. On subdividing the cylindrical colored filter glasses 202 or 203 into a number of different colored filter rings whose thickness is matched to the light-conducting bodies, the light radiated by the light source 1 which passes through these rings is also conducted further in a number of colors and accurately by the light-conducting bodies and it is transmitted by these to the associated light-refracting or light scattering bodies. This means that the light refracting or light scattering bodies 227–232 or 241–243, which are arranged into a number of concentric rings, can transmit light into the room in a different color or additionally multicolored light which is distributed on its circumference.

FIG. 4 shows a similar arrangement to that described in conjunction with FIG. 3, only with the difference that in the version according to FIG. 4 the light-refracting or light-scattering bodies form an enclosed ring, which is either connected directly with the projection of a disc-shaped, light-conducting body, or which is attached, as a closed ring shaped body, at a certain distance from the end of a projection, in which the directing effect is achieved at the end of the projections 315 to 318 or 322 to 324 by corresponding concave circular ring surfaces 315'–318' or 322'–324'.

The light energy radiated from the light source 1, or by the long, thin gas discharge path 2, is transmitted either directly or through the interposed cylindrical colored filter glasses 202 and 203, to the light conducting bodies 304–310, which in this version are also stacked, and to the reflecting surfaces 311–314 as well as 319–321 of these bodies.

The light is reflected by these reflecting surfaces and conducted further in the direction at right angles to the disc-shaped, light-conducting bodies into the projections 315–318 as well as 322–324 and from there is reaches the concave conducting ring surfaces 315'–318' or 322'–324'. The light is directed by these circular ring surfaces in circular conical form into the light-refracting or light-scattering bodies 325–328 as well as 329–331 which are arranged below or above the circular ring surfaces. Thus the light is distributed into the room by multiple refraction and scattering in these bodies. The circular light-refracting or light-scattering bodies are either connected directly with the projections 318 and 322–324 as shown by 328, 329, 330 and 331 or these light-refracting or light-scattering bodies are fastened at a certain distance from the projections 315–317, which is the case for the bodies 325–327.

Suitable materials for the arrangement according to the invention are, for example, transparent plastics or glass. It is however, also possible to produce the light-conducting, disc-shaped bodies in particular as composite elements, partly from plastics and partly from glass, in which the section produced from glass of each light-conducting body is situated in the direct vicinity of the light source 1, which is especially useful for high-power light sources.

What is claimed is:

1. In an arrangement for transmitting the light energy radiated by a light source having an elongated light-producing means, and comprising a stack of light-conducting bodies having walls running in parallel to a common plane, said walls extending sidewards from said light source and having reflecting surfaces at their respective ends remote from said light source, the improvement wherein, said bodies are arranged around said light source, and said means is substantially perpendicular to said plane, whereby each one of said bodies collects only a portion of the light produced by said means and transmits the collected light to its reflecting surface, thereby allowing said bodies to substantially fully collect the light produced by said means.

2. The arrangement according to claim 1 wherein, each light-conducting body is disc-shaped.

3. Arrangement according to claim 1, and a superposed Fresnel lens wherein the light energy transmitted by the reflecting surfaces of the light conducting bodies is supplied to the Fresnel lens which concentrates the light energy onto a common focal point.

4. The arrangement according to claim 3, and a circular cylindrical disc matched to said Fresnel lens.

5. The arrangement according to claim 3, and a light-conducting rod positioned to receive the concentrated light energy.

6. The arrangement according to claim 1, and a superposed circular lens disc having impressed, inclined circular ring surfaces with stepped different inclination angles, and the light energy transmitted by the reflecting surfaces is supplied to said circular lens disc whereby the light is transmitted by the inclined circular ring surfaces dependent upon the stepped inclination angles.

7. The arrangement according to claim 1, and a superposed circular ring disc having a number of concave circular surfaces, and a plurality of light-conductors arranged whereby the light transmitted by the reflecting surfaces of the light conducting bodies reaches the light conductors through the circular surface.

8. The arrangement according to claim 7, wherein said light conductors are cylindrical and concentric to each other, and each concave circular surface is operatively associated with a cylindrical light conductor.

9. Arrangement according to claim 1, wherein said reflecting surfaces of the light conducting bodies are arranged at different radial distances from said light source.

10. The arrangement according to claim 1, and at least one scattering lense positioned laterally relative to said light source such that the optical axis of said scattering lense coincides with the longitudinal axis of said elongated light-producing means.

11. The arrangement according to claim 1, and a collecting lense positioned laterally relative to said light-conducting bodies such that the optical axis of said collecting lense coincides with the longitudinal axis of said elongated light-producing means.

12. The arrangement according to claim 1, wherein at least one of said light-conducting bodies has a projection which is substantially perpendicular to said common plane, and the reflecting surface of said one light-conducting body is opposite to said projection.

13. The arrangement of claim 12, wherein said projection has a chamfered edge.

14. The arrangement according to claim 12, wherein the end of said projection is concave.

15. The arrangement according to claim 12, wherein the end of said projection is convex.

* * * * *